US011352106B2

(12) United States Patent
Childress

(10) Patent No.: US 11,352,106 B2
(45) Date of Patent: Jun. 7, 2022

(54) APPARATUS AND METHODS FOR DEPLOYING AN UNMANNED MARINE VEHICLE HAVING A PAYLOAD DEPLOYMENT ASSEMBLY

(71) Applicant: The Boeing Company, Chicago, IL (US)

(72) Inventor: Jamie Childress, Mercer Island, WA (US)

(73) Assignee: The Boeing Company, Chicago, IL (US)

( * ) Notice: Subject to any disclaimer, the term of this patent is extended or adjusted under 35 U.S.C. 154(b) by 3 days.

(21) Appl. No.: 16/779,558

(22) Filed: Jan. 31, 2020

(65) Prior Publication Data

US 2021/0237837 A1 Aug. 5, 2021

(51) Int. Cl.
*B63C 1/02* (2006.01)

(52) U.S. Cl.
CPC ..... *B63C 1/02* (2013.01)

(58) Field of Classification Search
CPC ..... B63C 1/02; B63B 23/40; B63B 27/10; B66C 23/52
See application file for complete search history.

(56) References Cited

U.S. PATENT DOCUMENTS 3,536,023 A 10/1970 Toher et al.
6,840,188 B1 * 1/2005 Witbeck ..... B63B 27/36 114/258
7,182,034 B2 2/2007 Brine
7,712,429 B1 * 5/2010 Gibson ..... B63B 27/36 114/312
8,640,640 B2 * 2/2014 Conti ..... B63B 1/121 114/61.15
8,813,669 B2 * 8/2014 Race ..... H01Q 1/04 114/244

(Continued)

OTHER PUBLICATIONS

MARTAC Beyond Human Capability; https://martacsystems.com/mantas-in-action/; accessed on Jan. 5, 2022; 4 pages.

(Continued)

*Primary Examiner* — S. Joseph Morano
*Assistant Examiner* — Jovon E Hayes
(74) *Attorney, Agent, or Firm* — Quinn IP Law

(57) ABSTRACT

Methods and apparatus are provided for deploying an unmanned marine vehicle into water, in which the unmanned marine vehicle includes a float and a glider connected by a tether. The apparatus includes a buoyant frame having a first frame arm, and a second frame arm spaced from the first frame arm to define a receiving bay between the first frame arm and the second frame arm, wherein the receiving bay is sized to receive the float. A glider retainer assembly is coupled to the buoyant frame and configured to releasably retain the glider. The apparatus further includes a payload deployment assembly having an attachment plate coupled to and positioned below the buoyant frame, and a payload compartment releasably coupled to the attachment plate by a payload release, wherein the payload compartment defines a receptacle sized to receive a payload coupled to the glider, and the payload compartment has a density greater than water.

20 Claims, 14 Drawing Sheets

(56) References Cited

U.S. PATENT DOCUMENTS

| | | | | |
|---|---|---|---|---|
| 8,944,866 | B2 * | 2/2015 | Hine | B63G 8/08 440/9 |
| 9,067,648 | B2 * | 6/2015 | Carcone | B63B 27/36 |
| 9,096,106 | B2 * | 8/2015 | Hanson | B60F 5/00 |
| 9,291,438 | B2 * | 3/2016 | Item | F42B 19/00 |
| 9,598,149 | B1 * | 3/2017 | Conn | B63B 27/36 |
| 9,745,034 | B2 * | 8/2017 | Childress | B64D 17/00 |
| 10,220,916 | B2 * | 3/2019 | Hooper | B63B 3/48 |
| 10,532,818 | B2 | 1/2020 | Childress | |
| 10,988,213 | B1 * | 4/2021 | Childress | B63B 23/40 |
| 11,148,766 | B2 | 10/2021 | Childress | |
| 11,148,769 | B2 | 10/2021 | Childress | |
| 2008/0202405 | A1 * | 8/2008 | Kern | B63B 23/30 114/259 |
| 2011/0083600 | A1 * | 4/2011 | Whitten | B63G 8/32 114/321 |
| 2012/0192780 | A1 * | 8/2012 | Soreau | B63B 23/32 114/259 |
| 2013/0291779 | A1 * | 11/2013 | Clarke | B63B 23/32 114/259 |
| 2017/0305516 | A1 | 10/2017 | Childress et al. | |
| 2021/0237837 | A1 | 8/2021 | Childress | |

OTHER PUBLICATIONS

General Dynamics Mission Systems; https://gdmissionsystems.com/products/underwater-vehicles/bluefin-9-autonomous-underwater-vehicle; accessed on Jan. 5, 2022; 8 pages.

* cited by examiner

APPARATUS AND METHODS FOR DEPLOYING AN UNMANNED MARINE VEHICLE HAVING A PAYLOAD DEPLOYMENT ASSEMBLY

FIELD

The present disclosure generally relates to deployment and/or recovery of unmanned marine vehicles (UMVs) and related payloads.

BACKGROUND

Deployment and recovery of UMVs involves manual labor and subjects the UMVs to possible damage. For example, certain UMVs include a buoyant structure, such as a float, intended to ride along the surface of a body of water, and a glider that is submerged under the water surface and provides a motive force to move the float. The glider is typically coupled to the float by a tether. Conventional deployment of such a UMV typically requires the UMV to be transported to a desired location on a body of water, such as by a ship or other vehicle, and multiple personnel to manually transfer the glider and float into the water. Care must be taken to place the glider and the float into the water in a sequence that ensures proper positioning and operation of the glider, as well as avoiding tangling of the tether with either the glider or the float. Retrieval of UMVs is similarly manually intensive, requiring a separate vehicle to travel to the vicinity of the UMV and multiple personnel to manually secure and remove the UMV from the water without damaging the UMV components. UMV deployment and retrieval can be further complicated by additional payloads to be deployed from the float once in the water. Still further, some applications may require deployment of multiple UMVs, in which case the above-noted drawbacks are exacerbated.

SUMMARY

In accordance with one aspect of the present disclosure, apparatus is provided for deploying an unmanned marine vehicle into water, in which the unmanned marine vehicle includes a float and a glider connected by a tether. The apparatus includes a buoyant frame having a first frame arm, and a second frame arm spaced from the first frame arm to define a receiving bay between the first frame arm and the second frame arm, wherein the receiving bay is sized to receive the float. A glider retainer assembly is coupled to the buoyant frame and configured to releasably retain the glider. The apparatus further includes a payload deployment assembly having an attachment plate coupled to and positioned below the buoyant frame, and a payload compartment releasably coupled to the attachment plate by a payload release, wherein the payload compartment defines a receptacle sized to receive a payload coupled to the glider, and the payload compartment has a density greater than water.

In accordance with another aspect of the present disclosure, a payload deployment assembly is provided for use with apparatus for deploying an unmanned marine vehicle into water. The payload deployment assembly includes an attachment plate coupled to and positioned below a buoyant frame of the apparatus, and a payload compartment releasably coupled to the attachment plate by a payload release, wherein the payload compartment defines a receptacle sized to receive a payload coupled to the glider, and the payload compartment has a density greater than water.

In accordance with a further aspect of the present disclosure, a payload kit is provided for use with apparatus for deploying an unmanned marine vehicle into water, in which the apparatus includes a buoyant frame for receiving a float of the unmanned marine vehicle and a glider retainer assembly coupled to the buoyant frame and configured to releasably retain a glider of the unmanned marine vehicle. The payload kit includes a payload with a sensor coupled to a tow cable, wherein the tow cable is configured for attachment to the glider of the unmanned marine vehicle. The kit further includes a payload deployment assembly having an attachment plate coupled to and positioned below the buoyant frame of the apparatus, and a payload compartment releasably coupled to the attachment plate by a payload release, wherein the payload compartment defines a receptacle sized to receive the payload, and the payload compartment has a density greater than water.

The features, functions, and advantages that have been discussed can be achieved independently in various examples or may be combined in yet other examples further details of which can be seen with reference to the following description and drawings.

BRIEF DESCRIPTION OF THE DRAWINGS

The novel features believed characteristic of the illustrative examples are set forth in the appended claims. The illustrative examples, however, as well as a preferred mode of use, further objectives and advantages thereof, will best be understood by reference to the following detailed description of illustrative examples of the present disclosure when read in conjunction with the accompanying drawings, wherein:

DETAILED DESCRIPTION

The figures and the following description illustrate specific examples of the claimed subject matter. It will thus be appreciated that those skilled in the art will be able to devise various arrangements that, although not explicitly described or shown herein, embody the principles of the examples and are included within the scope of the examples. Furthermore, any examples described herein are intended to aid in understanding the principles of construction, operation, or other features of the disclosed subject matter, and are to be construed as being without limitation to such specifically recited examples and conditions. As a result, the inventive concept(s) is not limited to the specific examples described below, but by the claims and their equivalents.

Deployment Apparatus

Figure 1:
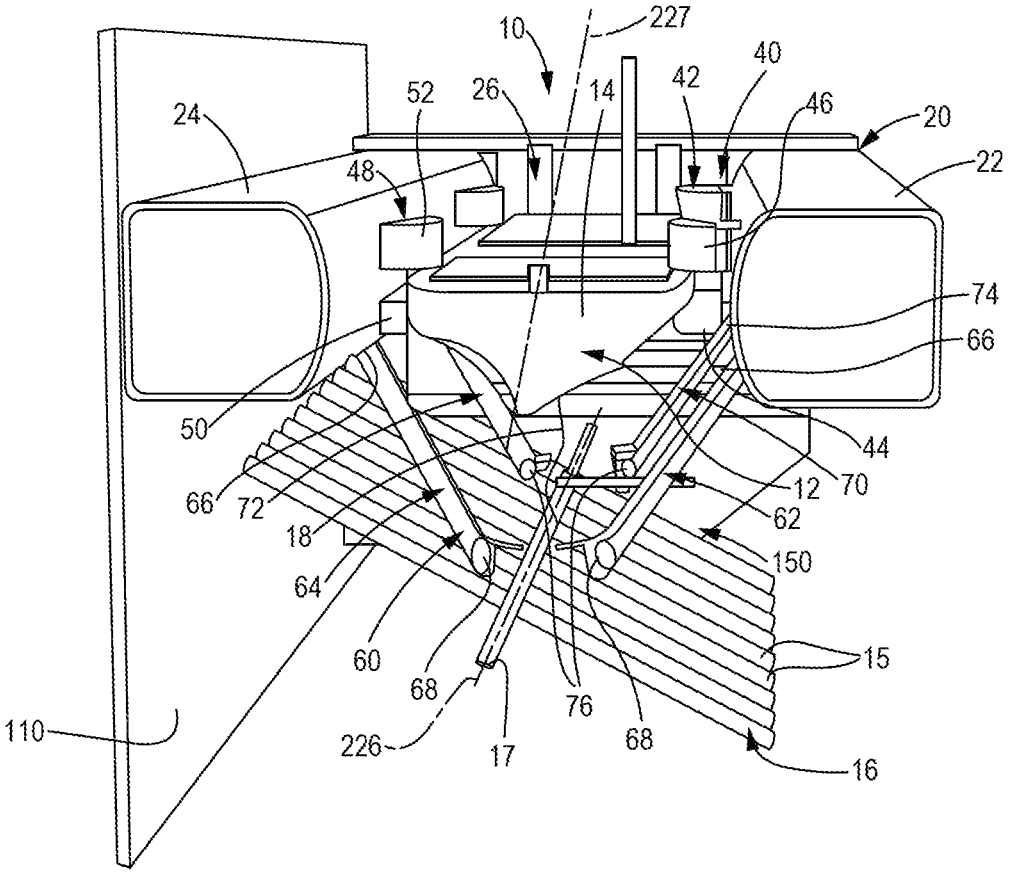
FIG. 1 is a perspective view of apparatus for deploying and/or retrieving a UMV attached to a side base, according to the present disclosure.

FIG. 1 illustrates apparatus 10 for deploying an unmanned marine vehicle (UMV) 12 into water. As used herein, the term "unmanned marine vehicle" is intended to encompass autonomous vehicles capable of operating on and/or below a surface of water. In the illustrated embodiment, the UMV 12 is a wave-powered vehicle that includes a float 14 for resting on the water surface and a glider 16 for submerging below the water surface and providing a motive force for moving the float 14. The glider 16 is connected to the float 14 by a tether 18. The glider 16 includes fins 15 pivotably connected to a central beam 17 to permit rotation of the fins 15 around a transverse axis within a constrained range, thereby to provide propulsion.

In operation, as a wave lifts the float 14, an upward force is applied to the tether 18 that pulls the glider 16 upwards through the water. In response to this motion, the fins 15 will rotate about the transverse axis to assume a downward sloping position. As water is forced downward through the glider 16, the downward sloping fins 15 generate forward thrust which pulls the float 14 forward. As the wave crests, the float 14 descends into a trough. The glider 16 also sinks, as it is heavier than water, maintaining tension on the tether 18. The fins 15 rotate about the transverse axis the other way, assuming an upward sloping position. As water is forced upwards through the swimmer, the upward sloping fins 15 generate forward thrust to again pull forward the float 14. In this manner, the glider 16 generates thrust when both ascending and descending, resulting in forward motion of the entire UMV 12.

Figure 2:
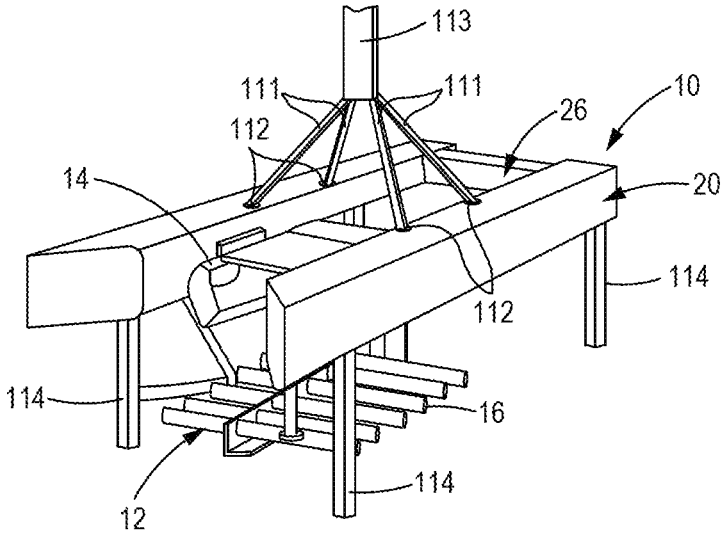
FIG. 2 is a perspective view of apparatus for deploying and/or retrieving a UMV having support legs and configured for hoisting by a lift, according to the present disclosure.
Figure 3:
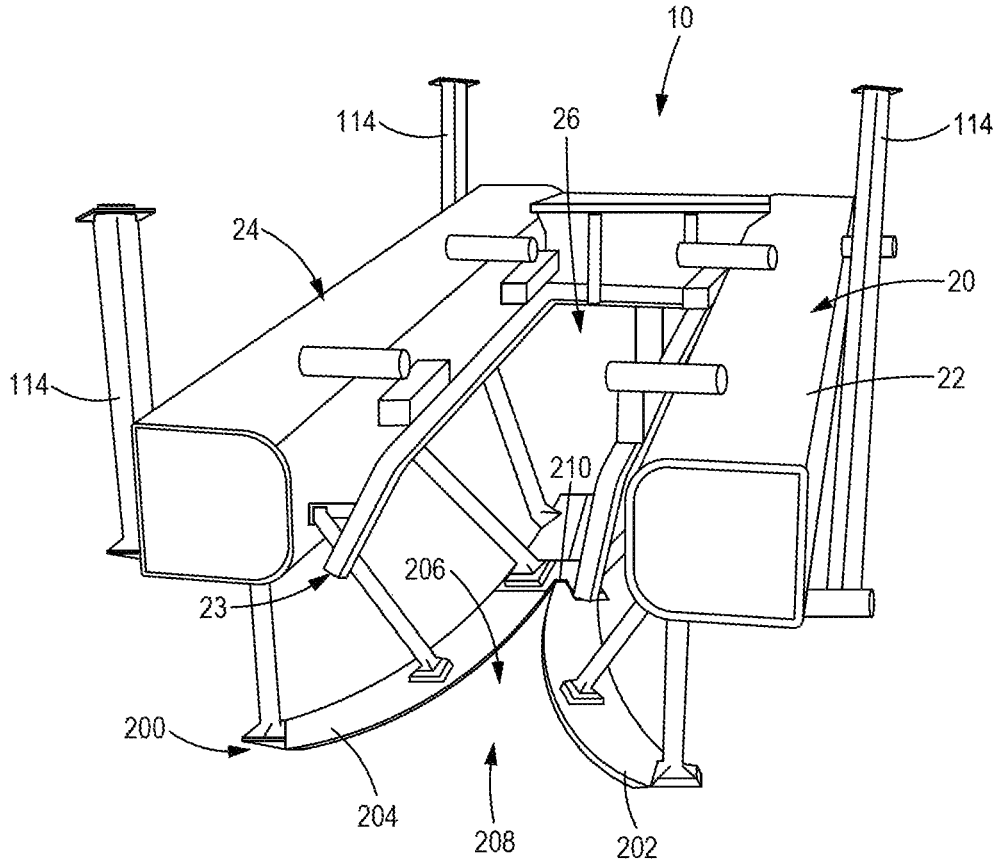
FIG. 3 is a perspective view of apparatus for deploying and/or retrieving a UMV according to the present disclosure, with the UMV removed for clarity.

The apparatus 10 is provided to secure the components of the UMV 12 to facilitate deployment and/or retrieval. As best shown in FIGS. 1-3, the apparatus includes a buoyant frame 20 including a first frame arm 22 and a second frame arm 24 spaced from the first frame arm 22 to define a receiving bay 26 between the first frame arm 22 and the second frame arm 24. The receiving bay 26 is sized to receive the float 14. In the illustrated example, the receiving bay 26 is sized to receive both a width and a length of the float 14.

The apparatus 10 includes a float clamp assembly 40 for releasably securing the float 14 within the receiving bay 26. More specifically, the float clamp assembly 40 is coupled to the buoyant frame 20 and has an extended configuration (FIG. 1), in which the float clamp assembly 40 is configured to retain the float 14 within the receiving bay 26, and a retracted configuration (FIG. 2), in which the float clamp assembly 40 is configured to disengage from the float 14. In the embodiment illustrated in FIG. 1, the float clamp assembly 40 includes a first float clamp 42 and a second float clamp 48. The first float clamp 42 includes a first stationary float clamp 44 coupled to the first frame arm 22 of the buoyant frame 20 and extending into the receiving bay 26. A first movable float clamp 46 is also coupled to the first frame arm 22 of the buoyant frame 20, and is movable between an extended position, in which the first movable float clamp 46 extends into the receiving bay 26 and is spaced from the first stationary float clamp 44 by a first clamp distance sized to receive a first lateral edge of the float 14, and a retracted position, in which the first movable float clamp 46 is withdrawn from the receiving bay 26. Similarly, the second float clamp 48 includes a second stationary float clamp 50 coupled to the second frame arm 24 of the buoyant frame 20 and extending into the receiving bay 26, and a second movable float clamp 52 coupled to the second frame arm 24 of the buoyant frame 20. The second movable float clamp 52 is movable between an extended position, in which the second movable float clamp 52 extends into the receiving bay 26 and is spaced from the second stationary float clamp 50 by a second clamp distance sized to receive a second lateral edge of the float 14, and a retracted position, in which the second movable float clamp 52 is withdrawn from the receiving bay 26. Accordingly, when both the first and second float clamps 42, 48 are in the extended configuration, opposite edges of the float 14 are secured in place. Conversely, when the first and second float clamps 42, 48 are in the retracted configuration, the float 14 is free to move relative to the buoyant frame 20 and out of the receiving bay 26.

The apparatus 10 further includes a glider retainer assembly 60 for releasably securing the glider 16. The glider retainer assembly 60 is coupled to the buoyant frame 20 and has a secured configuration, in which the glider retainer assembly 60 is configured to hold the glider 16 below the buoyant frame 20, and a released configuration, in which the glider retainer assembly 60 is configured to disengage from the glider 16. In the example illustrated in FIGS. 1, 2, 8, and 9, the glider retainer assembly 60 includes a first front glider arm 62 and a second front glider arm 64, each of the first front glider arm 62 and the second front glider arm 64 having a base end 66 coupled to the buoyant frame 20 and a free end 68. The glider retainer assembly further includes a first rear glider arm 70 and second rear glider arm 72, each of the first rear glider arm 70 and the second rear glider arm 72 having a base end 74 coupled to the buoyant frame 20 and a free end 76. A front glider arm retainer 78 couples the free end 68 of each of the first front glider arm 62 and the second front glider arm 64 to a front portion of the glider 16. Similarly, a rear glider arm retainer 80 couples the free end 76 of each of the first rear glider arm 70 and the second rear glider arm 72 to a rear portion of the glider 16.

The glider retainer assembly 60 is configured to accommodate a limited range of movement of the glider 16 while it is secured to the buoyant frame 20. More specifically, as best shown in FIG. 1, the glider 16 defines a longitudinal axis 226, and each of the front glider arm retainer 78 and the rear glider arm retainer 80 is configured to permit rotation of the glider 16 about the longitudinal axis 226 relative to the first front glider arm 62, the second front glider arm 64, the first rear glider arm 70, and the second rear glider arm 72. Permitting this rotational movement of the glider 16 prevents residual forces from damaging the glider 16, float 14, and apparatus 10 during transport and/or deployment of the UMV 12.

Figure 8:
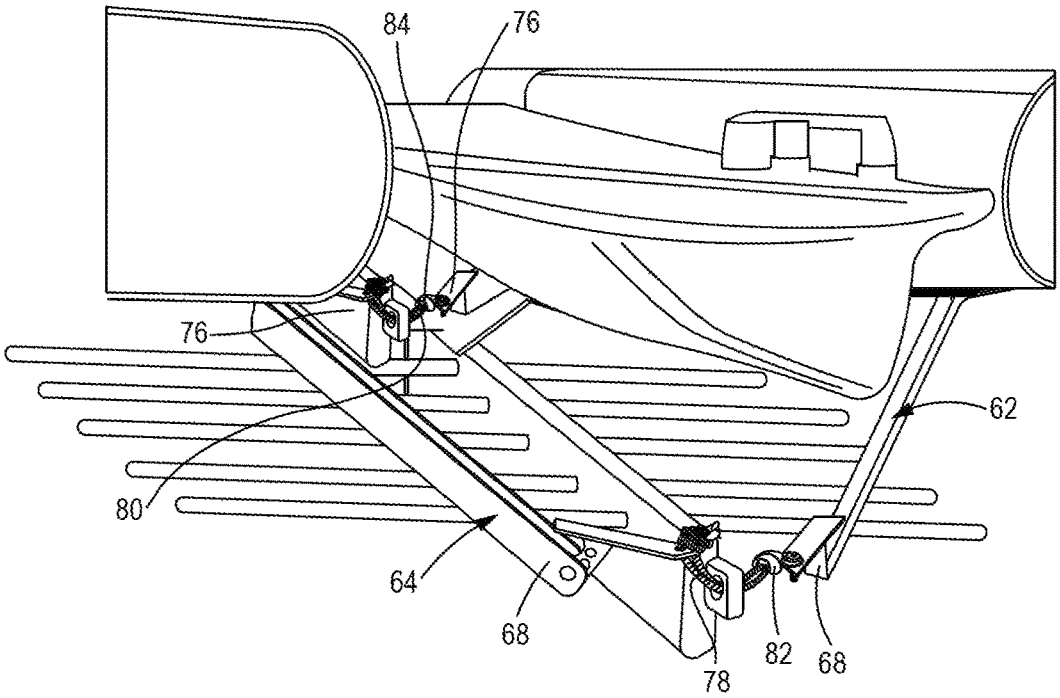
FIG. 8 is a perspective view of apparatus for deploying and/or retrieving a UMV according to the present disclosure showing deployment apparatus in greater detail.
Figure 9:
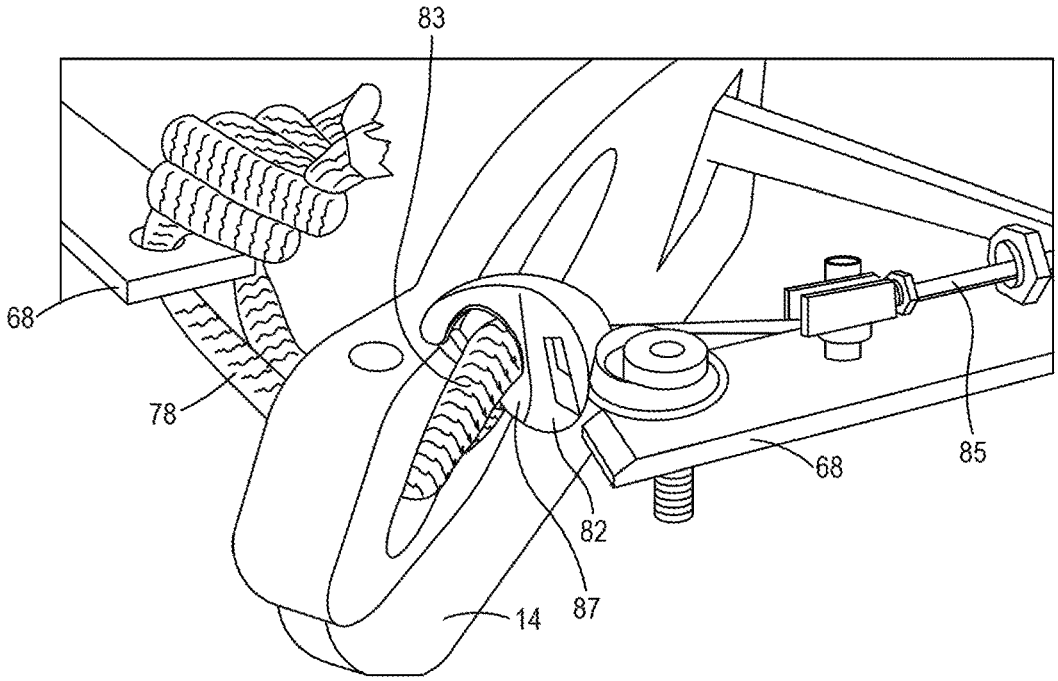
FIG. 9 is an enlarged perspective view of a front glider release of a glider retainer assembly provided on apparatus for deploying and/or retrieving a UMV according to the present disclosure.

The front and rear glider arms are secured to the buoyant frame 20 in a manner that permits them to automatically move from retain positions to release positions, thereby permitting deployment of the glider 16 into water without obstruction. More specifically, each of the first front glider arm 62, the second front glider arm 64, the first rear glider arm 70, and the second rear glider arm 72 has a retain position, in which the free end 68 or 76 is positioned relatively nearer to a longitudinal centerline 227 of the receiving bay 26, as best shown in FIG. 8. Each of the glider arms further may be biased to a release position, in which the free ends 68 or 76 are positioned relatively farther from the longitudinal centerline 227 of the receiving bay 26. The front glider arm retainer 78 secures each of the first front glider arm 62 and the second front glider arm 64 in the retain position, while the rear glider arm retainer 80 secures each of the first rear glider arm 70 and the second rear glider arm 72 in the retain position. A front glider arm release 82 is operatively coupled to the front glider arm retainer 78 and selectively operable to release the front glider arm retainer 78, thereby allowing each of the first front glider arm 62 and the second front glider arm 64 to automatically move to the release position. Similarly, a rear glider arm release 84 is operatively coupled to the rear glider arm retainer 80 and selectively operable to release the rear glider arm retainer 80, thereby allowing each of the first rear glider arm 70 and the second rear glider arm 72 to automatically move to the release position. As best shown in FIGS. 8 and 9, the front and rear glider arm retainers 78, 80 respectively comprise front and rear flexible cords, while the front and rear glider arm releases 82, 84 respectively comprise front and rear shackles. In operation, the shackles are operated by an actuator 85 to open a jaw 87 of the shackle, thereby releasing a loop 83 formed in the flexible cord. With the jaw 87 open, the front and rear glider arms automatically swing to the release positions, pulling the flexible cord through the glider 16 and positioning the arms so that they do not obstruct movement of the glider 16.

The apparatus 10 may be adapted for different types of transport and/or deployment operations. In the example shown in FIG. 1, the apparatus 10 includes a planar deployment base 110 coupled to buoyant frame 20. In this example, the planar deployment base 110 may be coupled to the side of a ship, in which case deployment into the water may be remotely initiated. Alternatively, the planar deployment base 110 may be placed on the deck of a ship, in which case a lift may be used to carry the apparatus 10 from the deck and over the side of the ship to for deployment. Still further, the planar deployment base 110 may be placed on top of a ramp provided on the deck of a ship or a dock, and slid over an edge of the ramp to transfer the apparatus 10 to the water.

In other embodiments, the apparatus 10 may be configured to facilitate hoisting by a lift apparatus. As best shown in FIG. 2, for example, pairs of lifting lugs 112 are coupled to each of the first frame arm 22 and the second frame arm 24 of the buoyant frame 20. The lifting lugs 112 permit attachment by straps 111 to a lift arm 113 of a lift apparatus (not shown). The lift apparatus may then be used to transfer the apparatus 10 from a storage location to the water. In this example, the apparatus 10 further may include retractable support legs 114 that allow the glider 16 to hang below the float 14 when the apparatus is in the storage location, prior to deployment. In the illustrated example, a pair of retractable support legs 114 is coupled to each of the first frame arm 22 and the second frame arm 24 of the buoyant frame 20. Each retractable support leg 114 is selectively moveable to a support position, in which a bottom end of the retractable support leg 114 is below a bottom of the buoyant frame 20, thereby to allow the glider 16 to be positioned below the float 14, as shown in FIG. 2. After the apparatus 10 is hoisted by the lift apparatus and prior to deployment into water, the retractable support legs 114 may be moved to retracted positions as shown in FIG. 3 so that the retractable support legs 114 do not interfere with deployment or retrieval operations, as discussed more fully below.

Impact Resistant Cage

Figure 11:
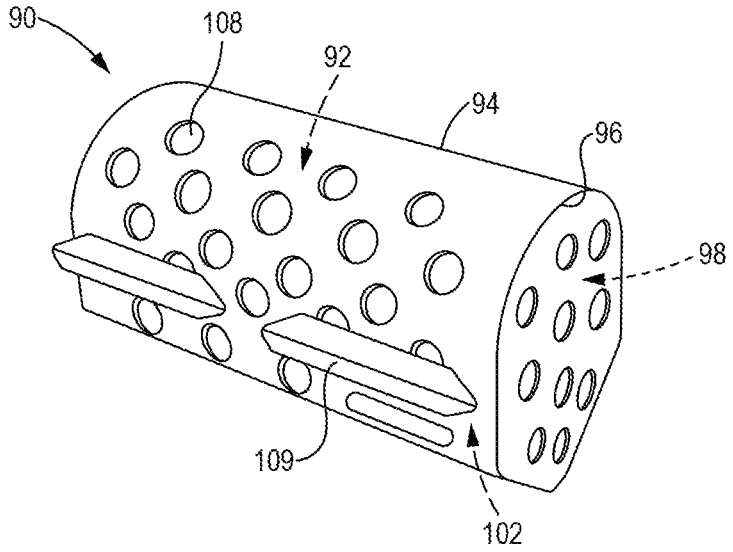
FIG. 11 is a perspective view of a rigid cage for protecting apparatus for deploying and/or retrieving a UMV according to the present disclosure.
Figure 12:
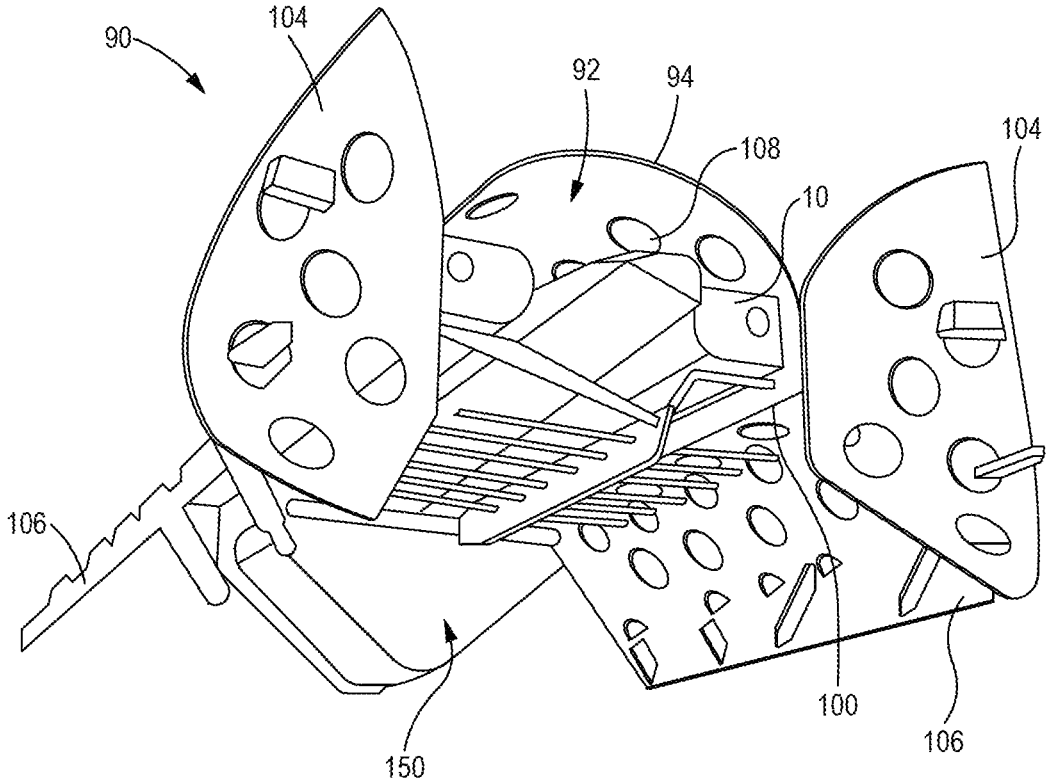
FIG. 12 is a perspective view of the rigid cage of FIG. 11, with a nose bay and a launch bay in open configurations.
Figure 13:
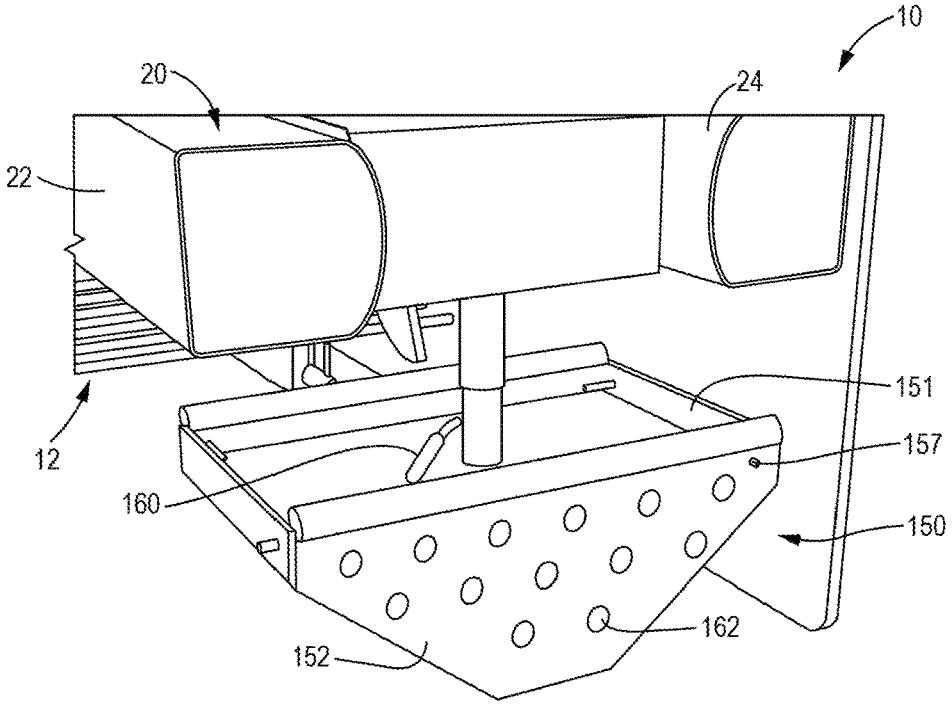
FIG. 13 is a perspective view of a payload deployment assembly provided with some examples of apparatus for deploying and/or retrieving a UMV according to the present disclosure, with the payload deployment assembly depicted in an attached configuration.
Figure 14:
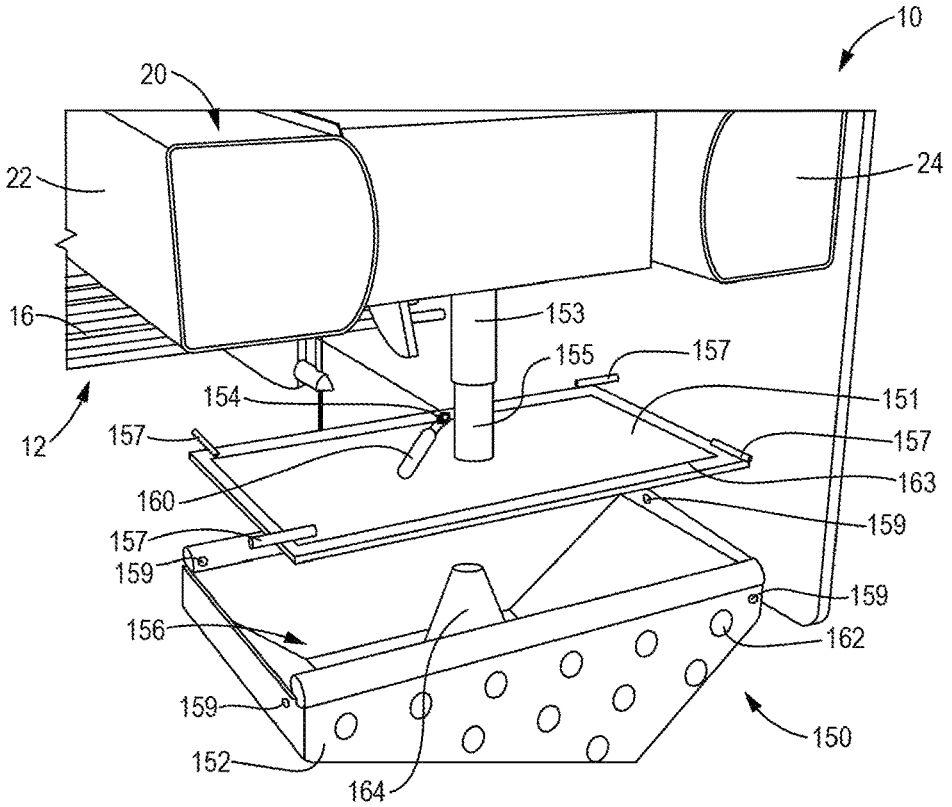
FIG. 14 is a perspective view of the payload deployment assembly of FIG. 13 in a deployed configuration.

In some examples a rigid cage 90 is provided to permit the apparatus 10 to be dropped into the water, such as from an aircraft. As best shown in FIGS. 11 and 12, the rigid cage 90 defines a cage chamber 92 for receiving the apparatus 10. More specifically, the buoyant frame 20 is disposed within the cage chamber 92 and is coupled to the rigid cage 90 (FIG. 12). The rigid cage 90 includes an upper hull 94 having a front end 96 defining a nose bay 98 and a bottom end 100 defining a launch bay 102. A pair of front doors 104 are pivotably coupled to the upper hull 94 and selectively movable between a closed position, in which the pair of front doors 104 extends across the nose bay 98, and an open position, in which the pair of front doors 104 permits access through the nose bay 98 to the cage chamber 92. A pair of bottom doors 106 is pivotably coupled to the upper hull 94 and selectively movable between a closed position, in which the pair of bottom doors 106 extends across the launch bay 102, and an open position, in which the pair of bottom doors 106 permits access through the launch bay 102 to the cage chamber 92. A plurality of fluid access ports 108 extend through the rigid cage 90 to permit water to enter into the cage chamber 92. In some examples, the rigid cage 90 may include a pair of buoyant pontoons 109 coupled to opposite lateral sides of the upper hull 94, to increase buoyancy and more quickly stabilize orientation of the rigid cage 90 in the water.

Positions of the front doors 104 and the bottom doors 106 are controlled to protect the apparatus 10 during impact with the water while subsequently permitting the apparatus 10 to deploy the UMV 12 into the water. More specifically, the front doors 104 and the bottom doors 106 of the rigid cage 90 are in the closed position as the apparatus 10 is dropped into the water, thereby to protect the apparatus 10 and the UMV 12 during impact. After the orientation of the rigid cage 90 in the water is stabilized, the bottom doors 106 are opened to allow the glider 16 to descend down into the water and begin generating a motive force. The front doors 104 also may be opened to permit the float 14 to egress from the rigid cage 90.

Payload Apparatus

In some examples, the apparatus 10 further includes a payload deployment assembly 150 for storing auxiliary equipment to be deployed into the water along with the UMV 12. Referring to FIGS. 13-16, the payload deployment assembly 150 includes an attachment plate 151 coupled to and positioned below the buoyant frame 20. In the illustrated embodiment, a socket 153 is coupled to the buoyant frame 20 and a post 155 is coupled to the attachment plate 151. The post 155 is sized for insertion into the socket 153, where it is locked in place. The payload deployment assembly 150 further includes a payload compartment 152. The payload compartment 152 defines a receptacle 156 sized to receive a payload 158 coupled to the glider 16, and the payload compartment 152 has a density greater than water. The payload compartment 152 further includes a plurality of fluid access ports 162 to permit water to flow into the payload compartment 152.

The payload compartment 152 is releasably coupled to the attachment plate 151 to permit deployment of the payload 158. More specifically, a plurality of retractable pins 157 are provided on the attachment plate 151 that are sized for insertion into apertures 159 provided on the payload compartment 152. A payload release 154 is operably coupled to the retractable pins 157, such as by a flexible line 163, wherein actuation of the payload release 154 withdraws the retractable pins 157 from the apertures 159, thereby permitting the payload compartment 152 to separate from the attachment plate 151. An actuator 160 may be operably coupled to the payload release 154 to automatically actuate the payload release 154.

Figure 15:
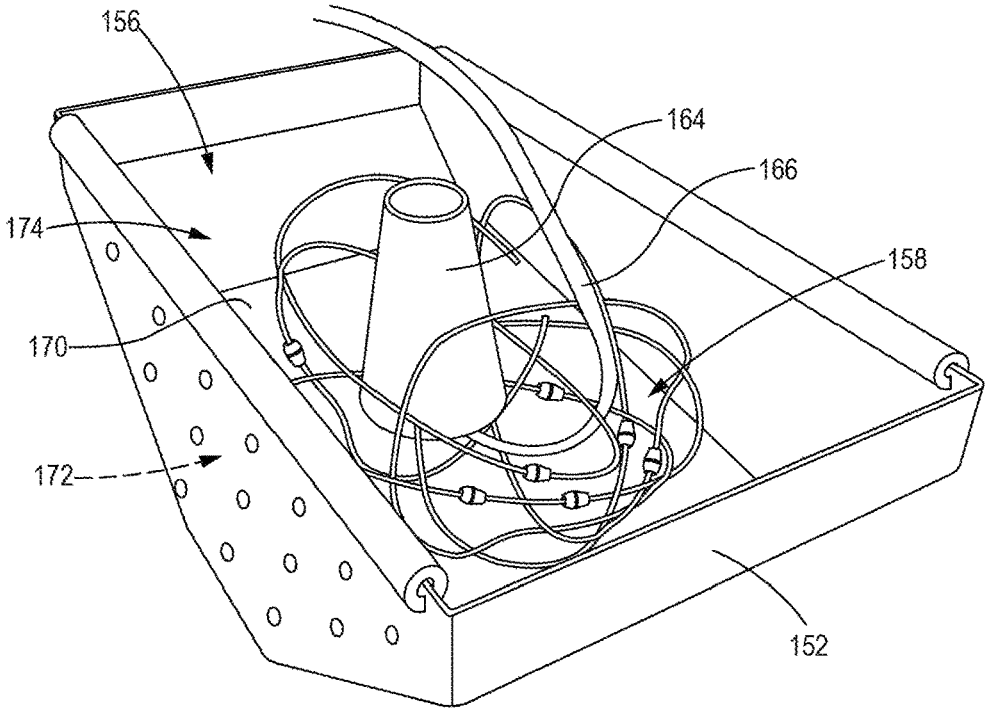
FIG. 15 is a perspective view of an interior of a payload compartment provided with the payload deployment assembly of FIGS. 13 and 14.
Figure 16:
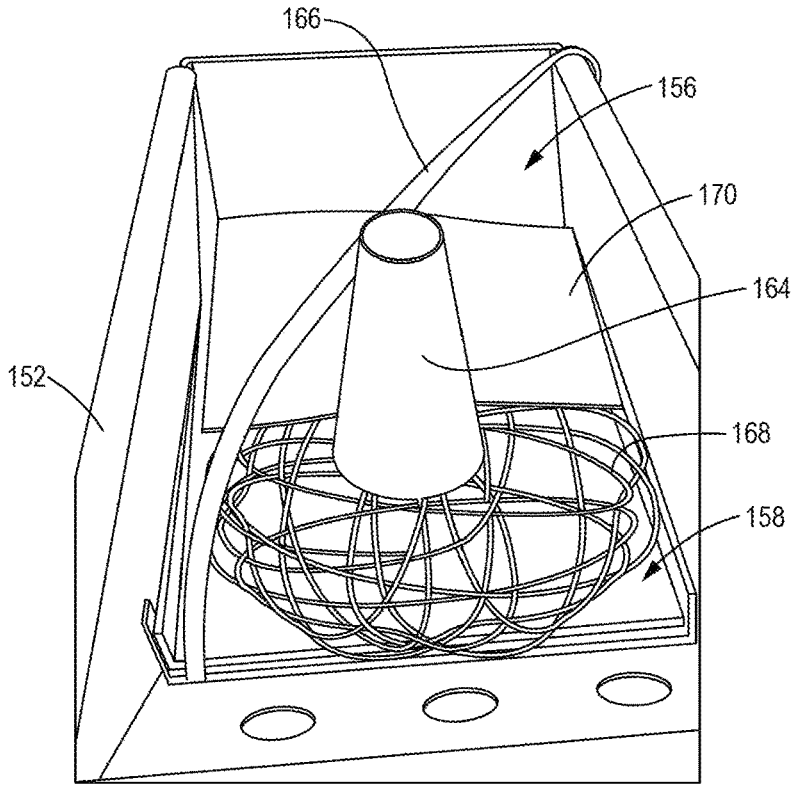
FIG. 16 is another perspective view of the interior of the payload compartment of FIG. 15, with a separator partially removed from the compartment.

The payload deployment assembly 150 may be configured to facilitate deployment of the payload 158 into the water after the payload compartment 152 is released from the attachment plate 151. As best shown in FIGS. 15 and 16, a spool 164 is disposed in the receptacle 156 about which a tow cable 166 of the payload 158 is wound in a coil pattern. The coil pattern may be reciprocating or otherwise configured to be a non-tangling coil pattern, thereby to permit full release of the payload 158 into the water. In some embodiments, the payload 158 includes a sensor 168 coupled to the tow cable 166, and the payload deployment assembly 150 further includes a separator 170 disposed in the payload compartment 152, wherein the separator 170 divides the payload compartment 152 into a lower compartment 172 sized to receive the sensor 168 and an upper compartment 174 sized to receive the tow cable 166.

Self-Propelled Vehicle

Figure 17:
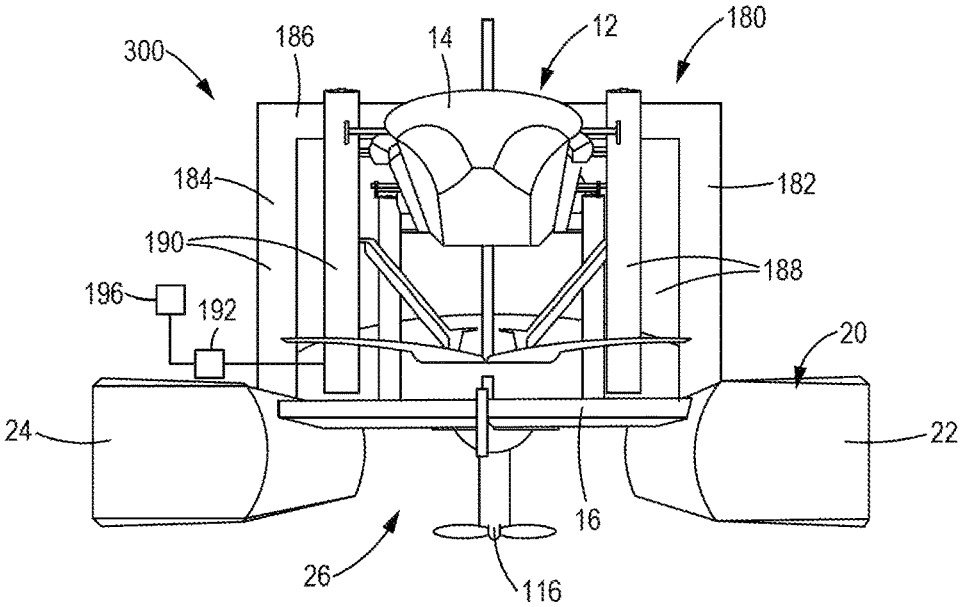
FIG. 17 is a perspective view of a self-propelled apparatus for deploying and/or retrieving a UMV according to the present disclosure, showing a lift assembly in a raised position.
Figure 18:
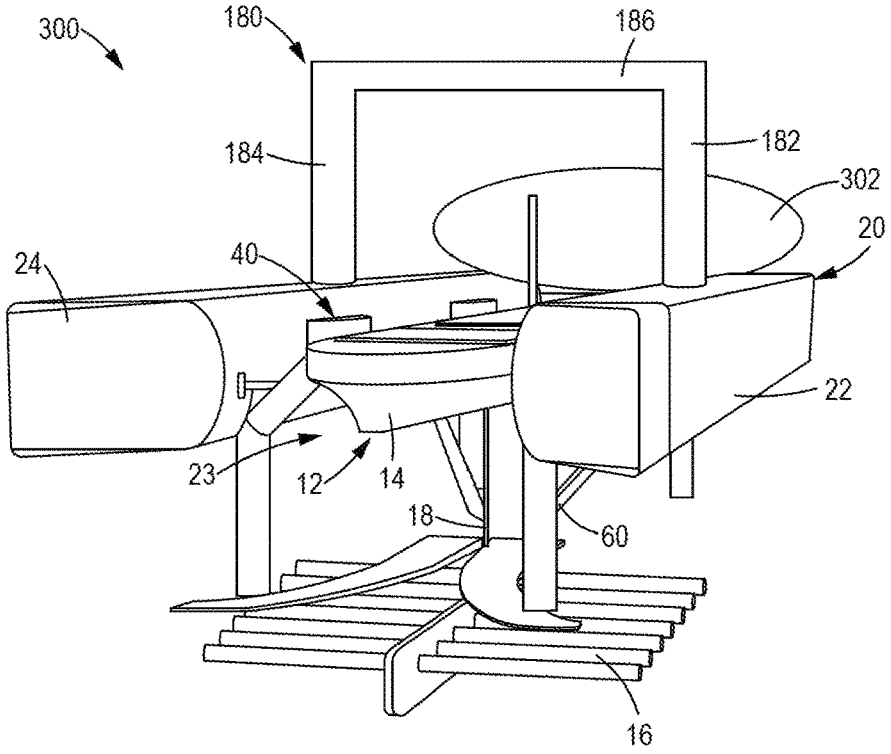
FIG. 18 is a perspective view of the self-propelled apparatus for deploying and/or retrieving a UMV of FIG. 17, with the lift assembly in a lowered position.

According to additional aspects, a self-propelled apparatus 300 for deploying the UMV 12 is provided that may be remotely positioned to the desired location of deployment. As best shown in FIGS. 17 and 18, the apparatus 300 includes structure similar to the foregoing examples, including the buoyant frame 20 having the first frame arm 22 and the second frame arm 24 spaced from the first frame arm 22 to define a receiving bay 26 sized to receive the float 14 of the UMV 12. The primary differences are that the apparatus 300 is self-propelled and has transport and deploy configurations, as discussed more fully below.

More specifically, the apparatus 300 includes a lift assembly 180 to move the UMV 12 between a transport position and a deployed position. The lift assembly 180 includes a first column 182 coupled to and extending above the first frame arm 22, a second column 184 coupled to and extending above the second frame arm 24, and a cross-support 186 extending between the first column 182 and the second column 184 to span across the receiving bay 26, with the cross-support 186 positioned above the buoyant frame 20. The lift assembly 180 further includes a pair of first lift rails 188 slidably coupled to the first column 182 and a pair of second lift rails 190 slidably coupled to the second column 184. A lift actuator 192 is operably coupled to the pair of first lift rails 188 and the pair of second lift rails 190 and configured to move the pair of first lift rails 188 and the pair of second lift rails 190 between a raised position, illustrated in FIG. 17, and a lowered position, illustrated in FIG. 18. The apparatus 300 further includes a motor 116 coupled to the buoyant frame 20 and configured to propel the apparatus 300 through water. A fuel tank 302 is coupled to the buoyant frame 20 and fluidly coupled to the motor 116.

As schematically illustrated in FIG. 17, a controller 196 controls operation of the components of the apparatus 300. More specifically, the controller 196 is operably coupled to the lift actuator 192, the float clamp assembly 40, the glider retainer assembly 60, and the motor 116. In some examples, the controller 196 is programmed to execute a method that includes, in a transport mode, operating the lift actuator 192 to place the pair of first lift rails 188 and the pair of second lift rails 190 in the raised position, and operating the motor 116 to propel the buoyant frame 20. The controller 196 is further programmed to execute a method that includes, in a deployment mode, operating the lift actuator 192 to place the pair of first lift rails 188 and the pair of second lift rails 190 in the lowered position. When operating in the deployment mode, the controller 196 further may be programmed to operate the float clamp assembly 40 to the retracted configuration, and operate the glider retainer assembly 60 to the released configuration, thereby to deploy the UMV 12 into the water to operate independent of the apparatus 300.

UMV Retrieval Apparatus

In addition to permitting storage, transfer, and deployment of the UMV 12, the apparatus 10 further may be configured to retrieve the UMV 12 for transport back to a storage location. Accordingly, as described in greater detail below, the apparatus 10 includes structure for capturing the float 14, the tether 18, and the glider 16, and further may secure these components of the UMV 12 in positions that minimize the risk of damage to the UMV 12 during subsequent transport and handling.

Figure 4A:
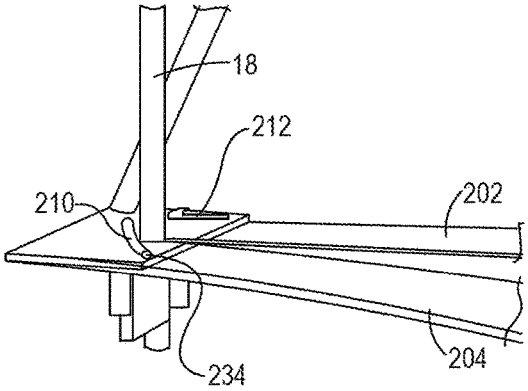
FIGS. 4A and 4B are perspective views of a tether capture sequence performed by apparatus for deploying and/or retrieving a UMV according to the present disclosure.
Figure 4B:
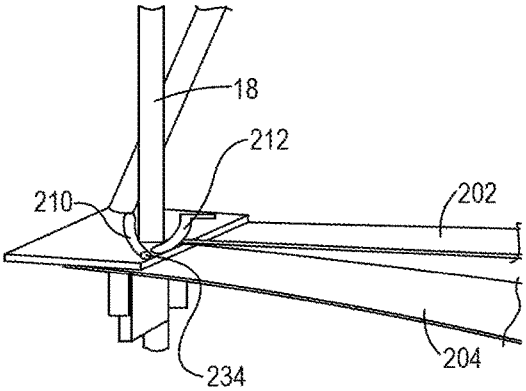
Figure 5:
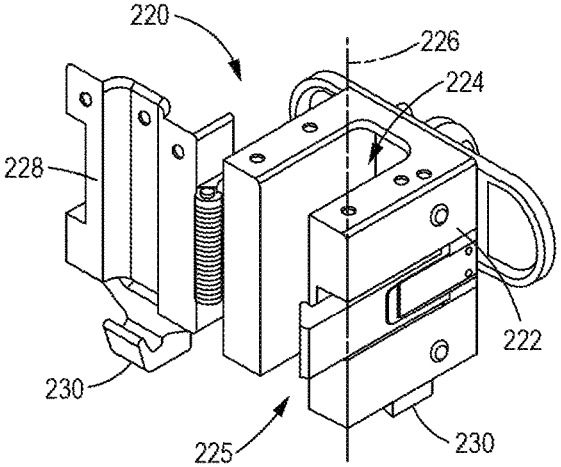
FIG. 5 is an enlarged perspective view of a tether block provided with apparatus for deploying and/or retrieving a UMV according to the present disclosure, with the tether block in an open configuration.
Figure 6:
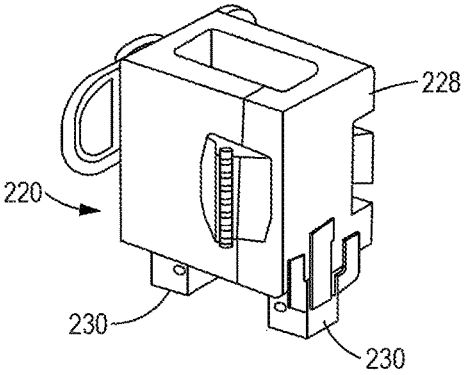
FIG. 6 is an enlarged perspective view of the tether block of FIG. 5 in a closed configuration.

Referring to FIGS. 3, 4A, and 4B, the apparatus 10 includes a glider recovery assembly 200 coupled to the buoyant frame 20 for capturing the glider 16 of the UMV 12. The glider recovery assembly 200 includes a first tether guide 202 and a second tether guide 204 coupled to the buoyant frame 20. The first tether guide 202 and the second tether guide 204 are cooperatively shaped to define a tether capture gap 206 having a tether inlet 208 adjacent the front end of the buoyant frame 20 and a tether stop 210 positioned rearward of the tether inlet 208. In the illustrated example, the first and second tether guides 202, 204 have arcuate shapes so that a distance between the first and second tether guides 202, 204 is at a maximum at the tether inlet 208 and at a minimum at the tether stop 210, thereby providing the tether capture gap 206 with a fluted, triangular shape. In general, the first and second tether guides 202, 204 are shaped so that the tether 18 of the UMV 12 is fed toward the tether stop 210 as the apparatus 10 is advanced in a forward direction.

The glider recovery assembly 200 is further configured to secure the tether 18 at the tether stop 210. More specifically, as best shown in FIGS. 4A and 4B, a capture arm 212 is positioned adjacent the tether stop 210 and movable between a receiving position (FIG. 4A), in which the capture arm 212 is retracted from the tether capture gap 206, and a securing position, in which the capture arm 212 extends across the tether capture gap 206. Additionally, a trigger switch 234 may be provided adjacent the tether stop 210 which, when contacted by the tether 18, moves from a deactivated position to an activated position, thereby to indicate that the tether 18 has reached the tether stop 210.

The glider recovery assembly 200 further comprises a tether block assembly 220 for gripping the tether 18 and hoisting the glider 16 to a position adjacent the buoyant frame 20, as best shown in FIGS. 5, 6, and 7A-C. The tether block assembly 220 includes a tether block body 222 defining a tether channel 224. The tether channel 224 extends along a longitudinal axis 226 and is sized to receive the tether 18. Additionally, the tether channel 224 has an open end 225 facing toward a front of the tether block body 222 that extends substantially perpendicularly to the longitudinal axis 226. A tether block door 228 is coupled to the tether block body 222 and movable between an open position (FIG. 5), in which the tether block door 228 is retracted from the open end 225 of the tether channel 224, and a closed position (FIG. 6), in which the tether block door 228 extends across and closes the open end 225 of the tether channel 224. The tether block assembly further includes a gripper 230 configured to couple to the glider 16. In the illustrated example, the gripper 230 is provided on the tether block door 228, however the gripper 230 may alternatively be provided on the tether block body 222. The tether block assembly 220 is movable between a stowed position (FIGS. 7A and 7B), in which the tether block assembly 220 is positioned below but relatively near the tether stop 210, and a deployed position (FIG. 7C), in which the tether block assembly 220 is positioned below but relatively farther away from the tether stop 210. In the deployed position, the gripper 230 couples to the glider 16.

Figure 7A:
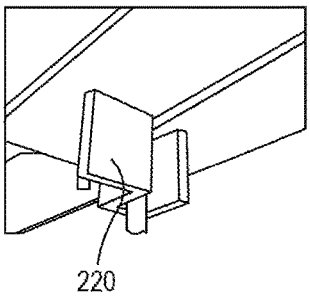
FIGS. 7A-7C are perspective view of a tether block sequence performed by apparatus for deploying and/or retrieving a UMV according to the present disclosure.
Figure 7B:
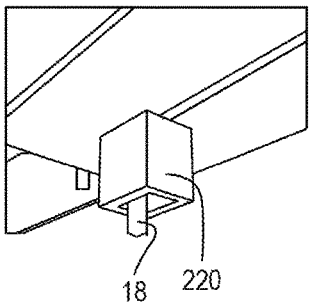
Figure 7C:
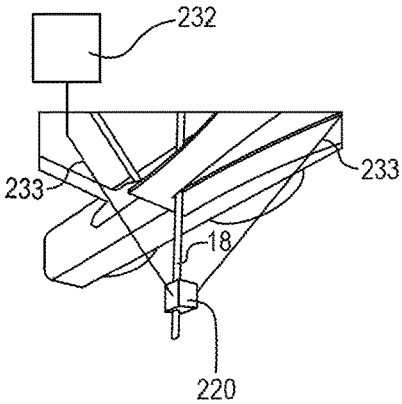

The tether block assembly 220 further includes a winch assembly for moving the tether block body 222 between the stowed and deployed positions. As best shown in FIG. 7C, the winch assembly includes a winch 232 coupled to the tether block body 222 by winch cables 233. The winch 232 may be actuated in a first direction to release additional lengths of the winch cables 233, thereby to lower the tether block body 222 from the stowed position to the deployed position. Additionally, the winch 232 may be actuated in a second, reverse direction to draw in the winch cable 233, thereby applying an upward force that raises the tether block body 222 and attached glider 16.

Figure 10:
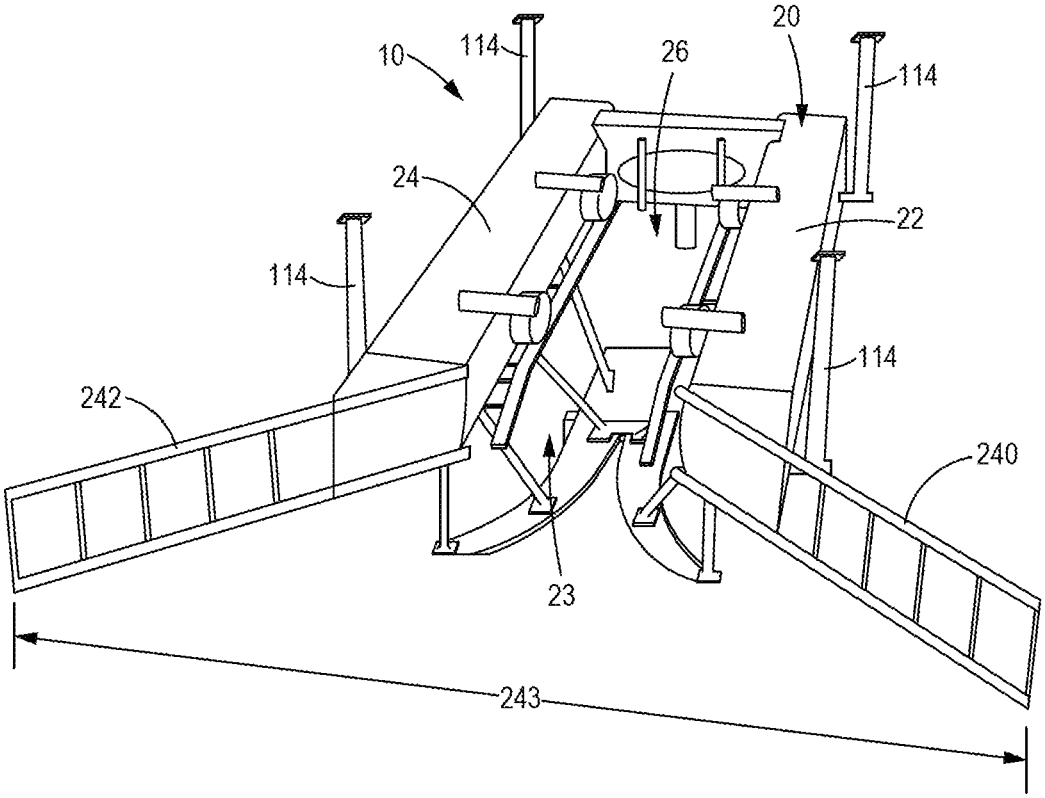
FIG. 10 is a perspective view of apparatus for deploying and/or retrieving a UMV according to the present disclosure, with the apparatus in a retrieval configuration.

In addition to the glider recovery assembly 200, the apparatus 10 further includes structure for guiding the float 14 into the receiving bay 26. As best shown in FIG. 10, for example, the apparatus 10 includes a first float capture rail 240 coupled to the first frame arm 22 of the buoyant frame 20, with the first float capture rail 240 extending forward of and laterally outwardly from the opening 23 of the receiving bay 26. Additionally, the apparatus 10 includes a second float capture rail 242 coupled to the second frame arm 24 of the buoyant frame 20, with the second float capture rail 242 extending forward of and laterally outwardly from the opening 23 of the receiving bay 26. Accordingly, the first and second float capture rails 240, 242 define a float capture span 243 that guides the float 14 into the receiving bay 26. As noted above, the apparatus 10 includes the float clamp assembly 40, which initially may be in the retracted configuration as the float enters the receiving bay 26. Once the float 14 is fully within the receiving bay 26, the float clamp assembly 40 may be actuated to the extended configuration to mechanically secure the float 14 within the receiving bay 26.

Deployment Sequence

The apparatus 10 may be operated to execute a deployment sequence during which the UMV 12 is released from the apparatus 10. The deployment sequence may be configured to deploy the glider 16 at an angle and at a time period relative to the float 14 to maximize the probability of successful deployment of the UMV 12 from the apparatus 10. Additionally, the deployment sequence may reduce the time period for the UMV 12 to achieve wave-induced propulsion.

Figure 19:
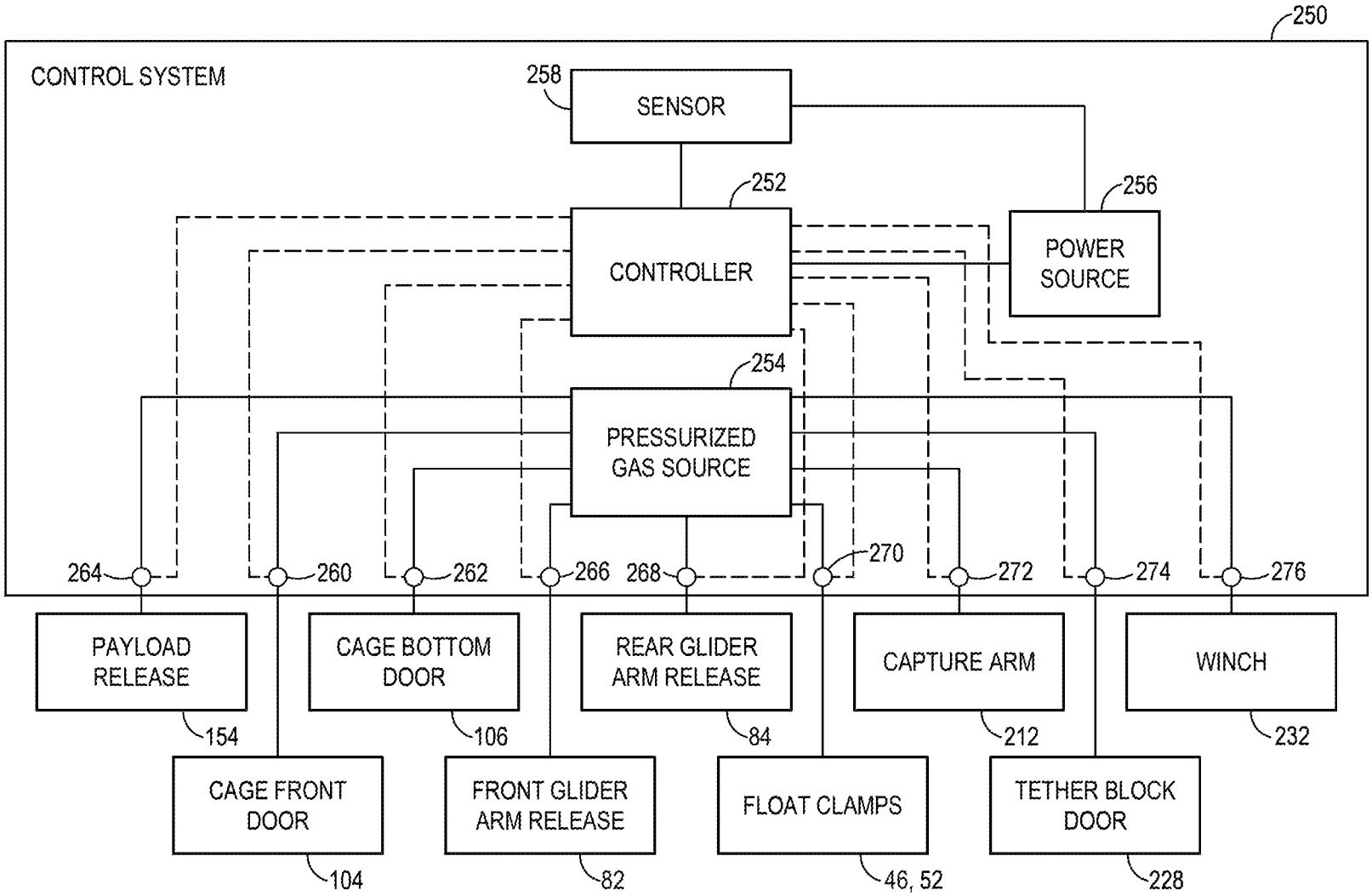
FIG. 19 is a schematic illustration of a controller for operating the apparatus for deploying and/or retrieving a UMV.

Referring to FIG. 19, the apparatus 10 includes a control system 250. The control system 250 may control various features of the apparatus 10, such as cage front door release, cage bottom door release, payload release, glider release, float release, tether capture, glider capture, and glider hoisting. While a specific control system 250 is shown and described, those skilled in the art will appreciate that various control systems may be used to perform the described operations.

As one specific, non-limiting example, the control system 250 may be pneumatic. Specifically, the control system 250 may include a controller 252, a pressurized gas source 254, a power source 256, an input from a sensor 258, and actuators 260, 262, 264, 266, 268, 270, 272, 274, and 276 (each of which may be a pneumatic release, a pneumatic valve, or other type of actuating device). Actuator 260 may be a pneumatic actuator associated with the cage front doors 104. Actuator 262 may be a pneumatic actuator associated with the cage bottom doors 106. Actuator 264 may be a pneumatic actuator associated with the payload release 154. Actuator 266 may be a pneumatic actuator associated with the front glider arm release 82. Actuator 268 may be a pneumatic actuator associated with the rear glider arm release 84. Actuator 270 may be a pneumatic actuator associated with the first and second movable float clamps 46, 52. Actuator 272 may be a pneumatic actuator associated with the capture arm 212. Actuator 274 may be a pneumatic actuator associated with the tether block door 228. Actuator 276 may be a pneumatic actuator associated with the winch 232. The controller 252 may be any apparatus or system, such as a computer, capable of receiving a signal from the sensor 258 and communicating command signals to the actuators 260, 262, 264, 266, 268, 270, 272, 274, and 276. The controller 252 may be electrically powered by the power source 256, which may be a batter (e.g., a lithium ion battery) or the like. The power source 256 may also electrically power the sensor 258.

The sensor 258 may be one or more devices capable of detecting a condition and generating a signal. For example, the sensor 258 may include a seawater sensor (e.g., a capacitance-based seawater sensor) which indicates when the apparatus 10 is in the water. Additionally or alternatively, the sensor 258 may include an impact sensor and/or an altimeter. Still further, the sensor 258 may include the trigger switch 234 associated with the capture arm 212. When the controller 252 receives a signal from the sensor 258, the controller 252 may initiate an actuation sequence.

The pressurized gas source 254 may include a pressure vessel housing a pressurized gas (e.g., air or nitrogen). The pressurized gas source 254 may be in fluid communication with the actuators 260, 262, 264, 266, 268, 270, 272, 274, and 276. When an actuator 260, 262, 264, 266, 268, 270, 272, 274, and 276 receives an actuation signal, the pressurized gas may effect actuation of the actuator 260, 262, 264, 266, 268, 270, 272, 274, and 276. Specifically, when actuator 260 is actuated, the cage front doors 104 may be released to the open position; when actuator 262 is actuated, the cage bottom doors 106 may be released to the open position; when actuator 264 is actuated, the payload release 154 is operated; when actuator 266 is actuated, the front glider arm release 82 is operated; when actuator 268 is actuated, the rear glider arm release 84 is operated; when actuator 270 is actuated, the first and second movable float clamps 46, 52 are operated; when actuator 272 is actuated, the capture arm 212 is operated; when actuator 274 is actuated, the tether block door 228 is operated; and when actuator 276 is actuated, the winch 232 is operated.

In certain examples, the controller 252 is programmed to execute a method of deploying the UMV 12 from the apparatus 10 into water. The method of deploying the UMV 12 may be initiated in response to an input signal from the sensor 258, such as from a seawater sensor, altimeter, impact sensor, or other sensor that provides a signal indicative of the apparatus 10 being in water. In response to the input signal, the controller 252 may be programmed to execute the method by actuating the actuator 266 to operate the front glider arm release 82, thereby releasing a front portion of the glider 16 from the apparatus 10. In some examples, releasing the front portion of the glider 16 comprises releasing the front glider arm retainer 78. Further, after a glider delay period of time, the controller 252 may actuate the actuator 268 to operate the rear glider arm release 84, thereby releasing a rear portion of the glider 16 from the apparatus 10. In some examples, releasing the rear portion of the glider 16 comprises releasing the rear glider arm retainer 80. Additionally, after a float delay period of time, the controller 252 may actuate the actuator 270 to operate the first and second movable float clamps 46, 52, thereby releasing the float 14 from the apparatus 10. Operating the rear glider arm release 84 after the front glider arm release 82 orients the glider 16 so that the front portion is angled downward into the water, thereby pointing the glider 16 in an orientation that will allow it to more quickly place the tether 18 in tension to apply a motive force to the float 14. In some examples, the glider delay period of time comprises about 0.001 seconds to about 0.5 seconds. Furthermore, operating the first and second movable float clamps 46, 52 after the rear glider arm release 84 stabilizes the orientation of the float 14 before it is advanced by the glider 16. In some examples, the float delay period of time comprises about 0.001 seconds to about 4.0 seconds.

Optionally, if a rigid cage 90 is provided, the controller 252 may be programmed to actuate the actuator 260 to open the cage front doors 104 and actuate the actuator 262 to open the cage bottom doors 106 in response to the input signal and prior to actuating the actuator 266 to operate the front glider arm release 82. Additionally, in examples including the payload deployment assembly 150, the controller 252 may be programmed to actuate the actuator 264 to operate the payload release 154 in response to the input signal, and waiting a payload delay period of time before actuating the actuator 266 to operate the front glider arm release 82. In some examples, the payload delay period of time comprises about 0.001 seconds to about 10.0 seconds.

UMV Retrieval Sequence

In certain examples, the controller 252 is programmed to execute a method of retrieving the UMV 12 from the water and into the apparatus 10. The method of retrieving the UMV 12 may be initiated in response to an input signal from the sensor 258, such as from the trigger switch 234 associated with the capture arm 212 when engaged by the tether 18. For example, the input signal may be generated when the tether 18 is guided through the capture gap 206 to the tether stop 210, where the trigger switch 234 is located. In response to the input signal, the controller 252 may be programmed to automatically execute a series of steps to retrieve the UMV 12. For example, the controller 252 may actuate the actuator 272 to operate the capture arm 212 from the receiving position to the securing position, thereby to secure the tether 18. With the tether 18 secured by the capture arm 212, a portion of the tether 18 will pass through the tether channel 224. Next, the controller 252 actuates the actuator 274, thereby to close the tether block door 228. The controller 252 may actuate the actuator 276, thereby to operate the winch so that it lower the tether block body 222, guided by the tether 18, from the stowed position to the deployed position. In the deployed position, the gripper 230 couples to the glider 16. Next, the controller 252 may actuate the actuator 276, thereby to operate the winch so that it raises the tether block body 222 and attached glider 16 from the deployed position to the stowed position, so that the glider 16 is raised to a position adjacent a bottom of the buoyant frame 20 of the apparatus 10. Subsequently, after the float 14 is guided into the receiving bay 26, the controller 252 may actuate the actuator 270 to operate the first and second movable float clamps 46, 52 from the retracted positions to the extended positions, thereby to secure the float 14 within the receiving bay 26. It will be appreciated that guiding the float 14 into the receiving bay 26 may include providing the first and second float capture rails 240, 242 on the front end of the buoyant frame 20, and advancing the apparatus 10 forward with the float 14 aligned between the first float capture rail 240 and the second float capture rail 242. With the glider 16 hoisted below the buoyant frame 20, the components of the UMV 12 are mechanically secured to permit transport and transfer to a storage location while minimizing the risk of damage.

Deployment of Multiple Unmanned Marine Vehicles

In certain examples, it may be desired to deploy multiple UMVs 12, in relatively rapid succession, from a carrier vehicle. In these examples, it may be advantageous to quickly transfer the UMVs 12 from the carrier vehicle to the water while minimizing damage to the UMVs 12. Securing the UMVs 12 in apparatus 10 having an impact-resistant shell may help achieve these goals. FIGS. 20-28 illustrate alternative systems 400 that permit rapid deployment of multiple UMVs 12.

Figure 20:
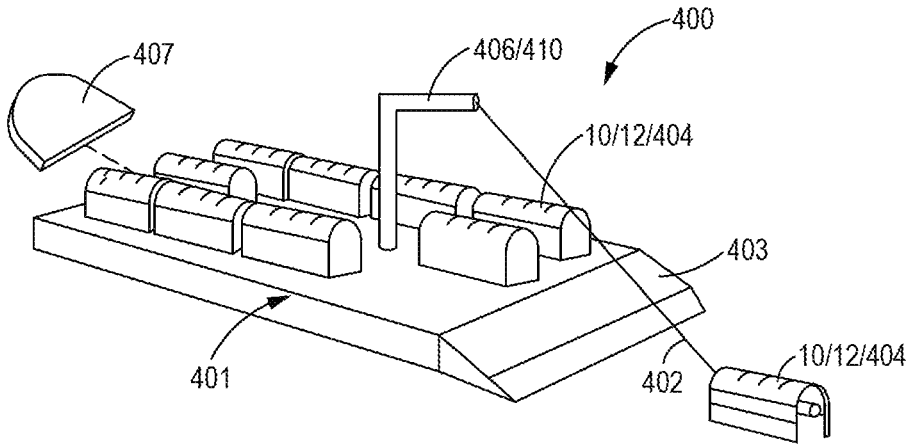
FIG. 20 is a perspective view of a buoyant platform configured for rear deployment of a plurality of apparatuses for deploying and/or retrieving a UMV, according to the present disclosure.

FIG. 20 illustrates a first example of a system 400 for rear-deployment of a plurality of UMVs 12 into water. Each UMV 12 may include the float 14 and the glider 16 connected by the tether 18, as described above. Furthermore, each UMV 12 initially may be carried in the apparatus 10 described above, having the buoyant frame 20 defining the receiving bay 26, the float clamp assembly 40 configured to selectively retain the float 14 of the respective UMV 12 in the receiving bay 26, and the glider retainer assembly 60 configured to selectively hold the glider 16 of the respective UMV 12 below the buoyant frame 20. Additionally, an impact-resistant shell 404 surrounds the buoyant frame 20 of the apparatus 10 and is sized to receive the respective UMV 12. In some examples, the impact-resistant shell 404 may be provided as the rigid cage 90 described above. The system 400 further includes a buoyant platform 401 sized to carry each of the UMVs 12 with associated apparatus 10 and impact-resistant shell 404. In this example, the buoyant platform 401 comprises a barge having a ramp 403 located at a rear end of the buoyant platform 401. The buoyant platform 401 may be self-propelled or pulled by a water vehicle 407. A lift 406 is provided on the buoyant platform 401 and is configured to transfer each respective UMV 12 and associated apparatus 10 and impact-resistant shell 404 to a water transfer area defined by the ramp 403. In the example of FIG. 20, the lift 406 is provided as a crane 410. A retrieve line 402 may extend between the lift 406 and the impact-resistant shell 404 to permit retrieval of the impact-resistant shell 404 and apparatus 10 after the UMV 12 has been deployed into the water. Accordingly, the lift 406 remains coupled to the apparatus 10 and impact-resistant shell 404 after the deployment sequence. In operation, the crane 410 transfers each UMV 12 to the ramp 403, and the forward movement of the buoyant platform 401 causes the UMV 12 to slide into the water off of the back end of the buoyant platform 401.

Figure 21:
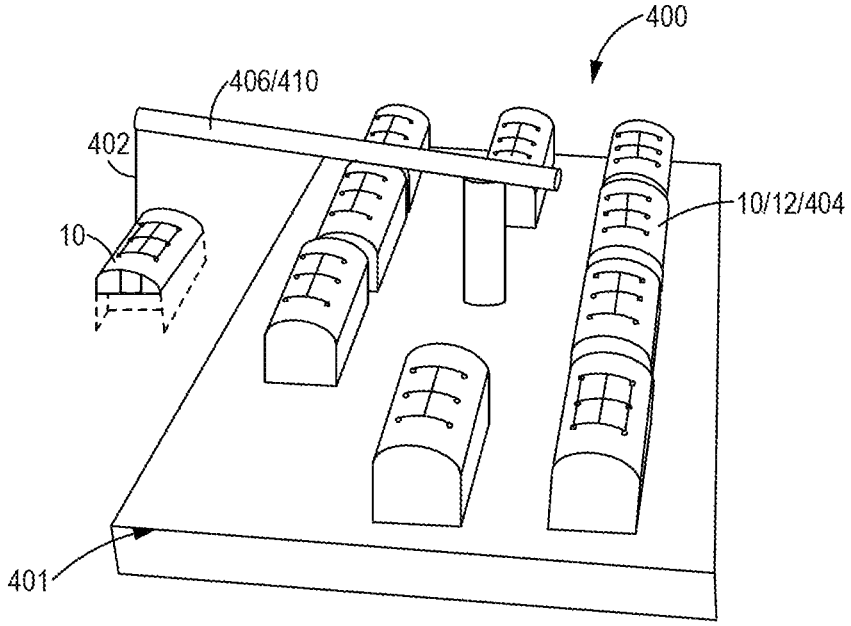
FIG. 21 is a perspective view of a buoyant platform configured for side deployment of a plurality of apparatuses for deploying and/or retrieving a UMV, according to the present disclosure.
Figure 22:
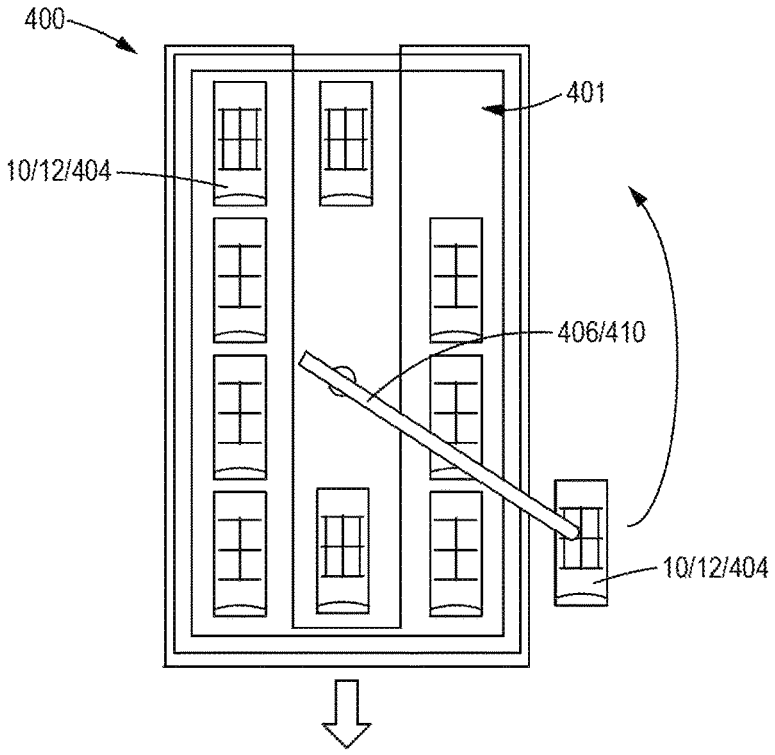
FIGS. 22 and 23 schematically illustrate a side deployment sequence carried out by the buoyant platform of FIG. 21.
Figure 23:
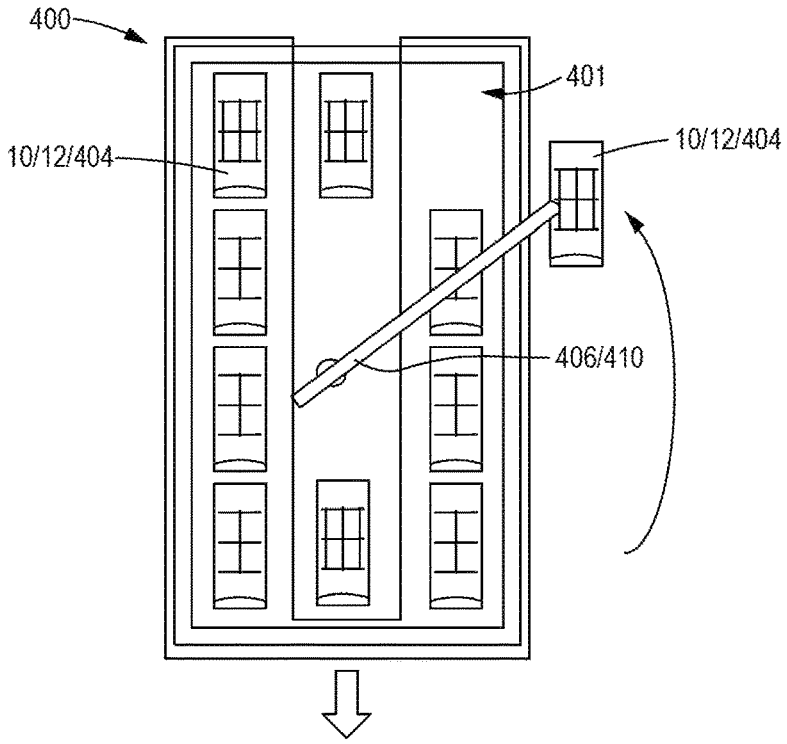

FIGS. 21-23 illustrate an alternative example of a system 400 for side deployment of a plurality of UMVs 12. In this example, the buoyant platform 401 is a flat barge which may omit the ramp 403 shown in the example illustrated at FIG. 20. The lift 406 may be provided as a crane 410 configured to transfer each UMV 12 from an initial location on the buoyant platform 401 to a water transfer area located to the side of the buoyant platform 401. As shown in FIGS. 22 and 23, which assumes that the buoyant frame is traveling in a downward direction, the crane 410 remains connected to the impact-resistant shell 404 by the retrieve line 402 as the UMV 12 (and associated apparatus 10 and impact-resistant shell 404) travel from a forward location (FIG. 22) to a rearward location (FIG. 23), during which a deployment sequence may be performed to release the UMV 12 from the apparatus 10. The impact-resistant shell 404 and apparatus 10 may then be transported back to buoyant platform 401.

Figure 24:
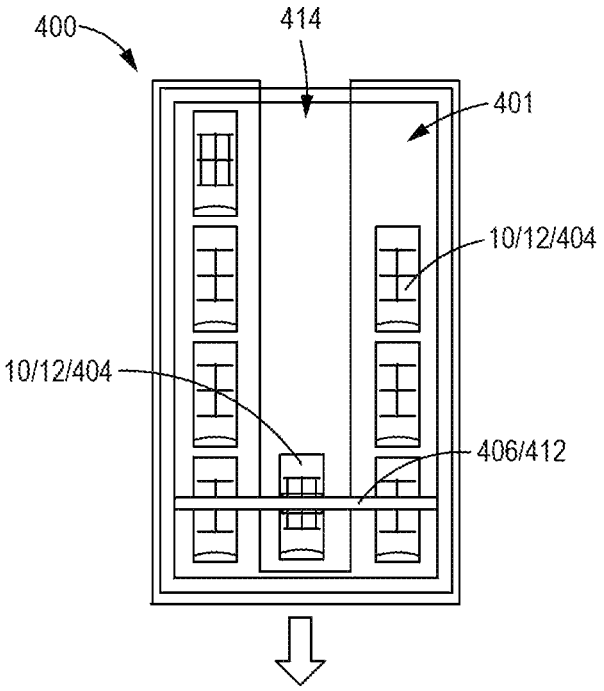
FIGS. 24 and 25 schematically illustrate a gantry style buoyant platform executing a deployment sequence according to the present disclosure.
Figure 25:
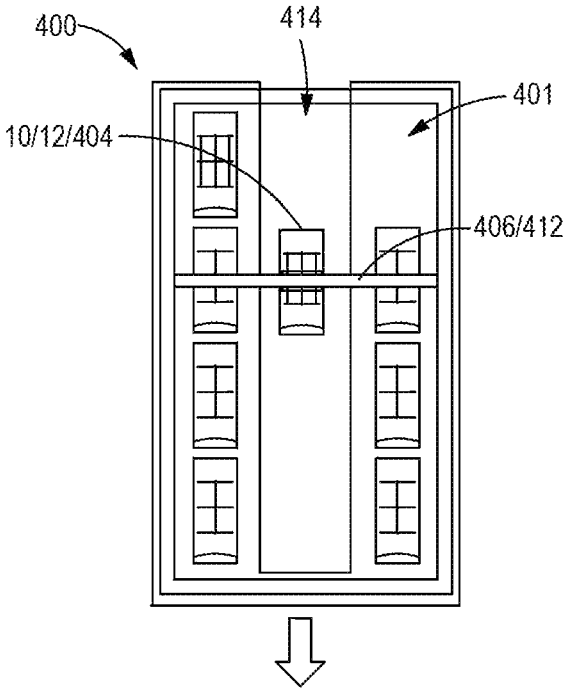

FIGS. 24 and 25 illustrate a further example of a system 400 for deploying a plurality of UMVs 12, using a gantry style buoyant platform 401. In this example, the lift 406 is provided as a gantry 412 that is movable from a forward position on the buoyant platform 401 (FIG. 24) to a rearward position on the buoyant platform 401 (FIG. 25). The gantry 412 is configured to lift and transfer each impact-resistant shell 404 carrying an associated apparatus 10 and UMV 12 to a water transfer area defined by a central bay 414 formed in the buoyant platform 401. As the buoyant platform 401 is advanced in the downward direction as shown in FIGS. 24 and 25, the UMV 12 and gantry 412 move from the forward position to the rearward position, during which time a deployment sequence may be performed to release the UMV 12 into the water. The gantry 412 may remain coupled to the impact-resistant shell 404 during and after the deployment sequence to permit recovery of the impact-resistant shell 404 and associated apparatus 10.

Figure 26:
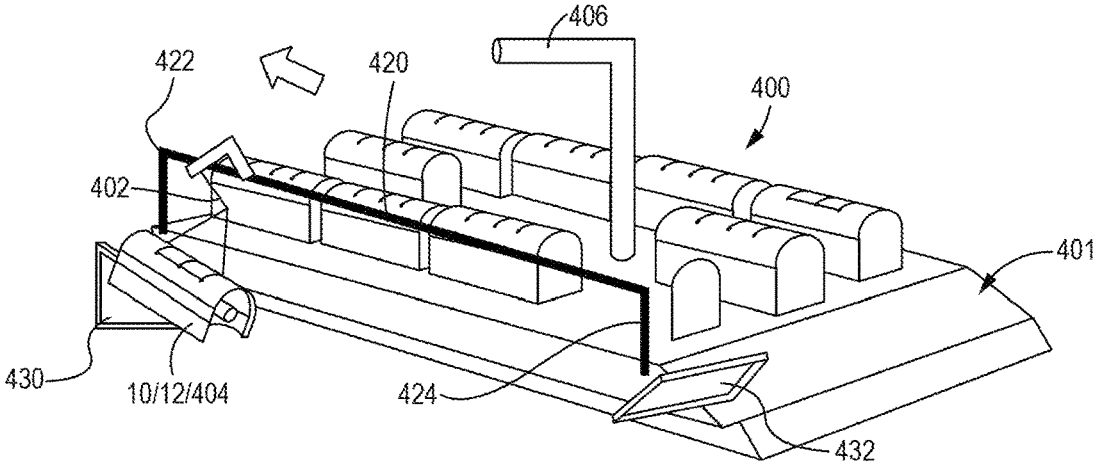
FIGS. 26, 27, and 28 are perspective views of a side-deploying buoyant platform executing a deployment sequence according to the present disclosure.
Figure 27:
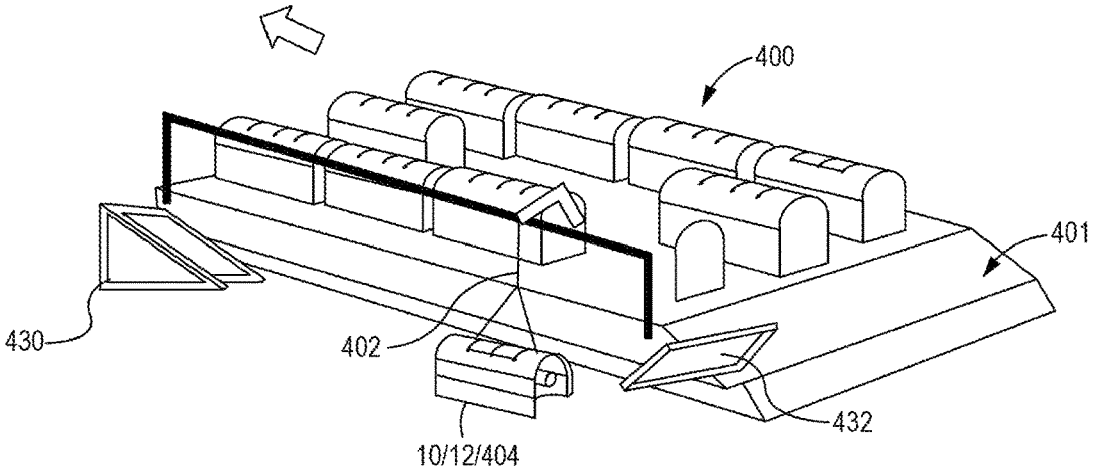
Figure 28:
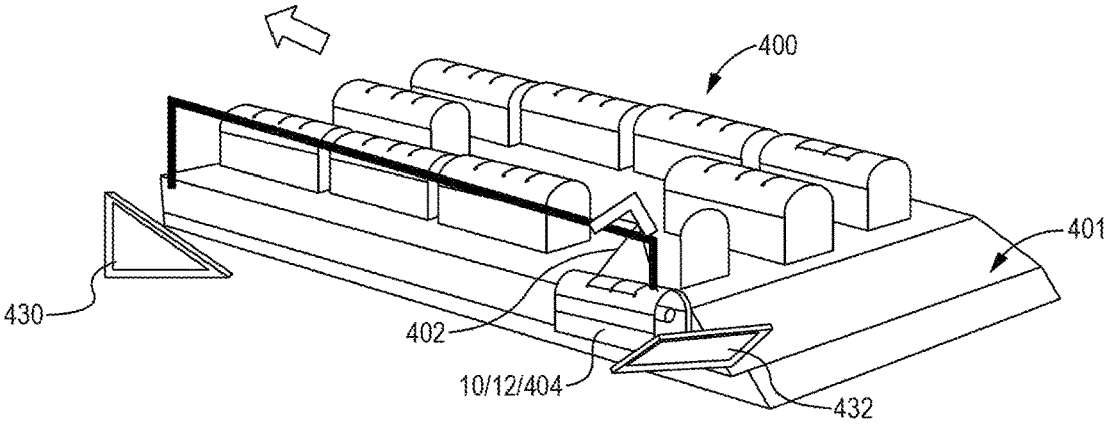

FIGS. 26-28 illustrate yet another example of a system 400 for deploying a plurality of UMVs 12, using side transfer and retrieval ramps. In this embodiment, the buoyant platform 401 further includes a travel rail 420 having a transfer end 422, positioned adjacent the water transfer area, and a retrieval end 424. The retrieve line 402 of each associated apparatus 10 is attached to the travel rail 420 and configured to traverse the travel rail 420 from the transfer end 422 to the retrieval end 424. A transfer ramp 430 is located on a lateral side of the buoyant platform 401, and a retrieval ramp 432 is located on the same the lateral side of the buoyant platform 401 and rearwardly of the transfer ramp 430. The lift 406, which may be provided as a crane 410, is configured to lift and transfer each respective UMV 12 from an initial position to the transfer ramp 430. As the buoyant platform 401 advances, the UMV 12 will slide off of the transfer ramp 430 and float toward the rearward end of the buoyant platform, during which time a deployment sequence may be performed to release the UMV 12 into the water. Subsequently, the retrieval ramp 432 may be used to recover the impact-resistant shell 404 and associated apparatus 10.

Each of the examples illustrated in FIGS. 20-28 may be used to execute a method of deploying a plurality of UMVs 12 into water. For example, the method may include advancing the buoyant platform 401 through the water, with the buoyant platform 401 carrying the plurality of UMVs 12. Each respective UMV 12 of the plurality of UMVs 12 is secured in an associated apparatus 10 comprising a buoyant frame 20 defining a receiving bay 26, a float clamp assembly 40 coupled to the buoyant frame 20 and configured to selectively retain a float 14 of the respective UMV 12 in the receiving bay 26, and a glider retainer assembly 60 configured to selectively hold the glider 16 of the respective UMV 12 below the buoyant frame 20. The method may further include transferring each respective UMV 12 and associated apparatus 10 from the buoyant platform 401 to the water. For example, any of the techniques described above may be used to transfer the UMV 12 from the platform to the water. The method continues by deploying each respective UMV 12 from the associated apparatus 10, thereby to release a plurality of UMVs into the water.

In some examples, transferring each UMV 12 from the buoyant platform 401 to the water may include transferring a first UMV 12 and associated apparatus 10 from the buoyant platform 401 to the water, and waiting a transfer delay period of time before transferring each subsequent UMV 12 and associated apparatus 10 from the buoyant platform 401 to the water. The transfer delay period of time may be a range of about three seconds to about ten seconds, or a range of about four seconds to about five seconds.

The relative speeds of the water current and the buoyant platform may be considered when executing the method of deploying a plurality of UMVs 12 into the water. For example, the water may have a water current that flows in a current direction and at a current speed. Advancing the buoyant platform 401 through the water, therefore, may include advancing the buoyant platform 401 in a platform direction against the current direction and at a platform speed that is within approximately 1 knot of the current speed.

In some examples, the method may further include retrieving each apparatus 10 after the associated UMV 12 is deployed. For example, a retrieve line 402 may still be coupled between the buoyant platform 401 and the apparatus 10, in which case the method may include, after deploying each UMV 12 from the associated apparatus 10, retrieving each apparatus 10 from the water using the retrieve line 402.

Any of the various elements shown in the figures or described herein may be implemented as hardware, software, firmware, or some combination of these. For example, an element may be implemented as dedicated hardware. Dedicated hardware elements may be referred to as "processors", "controllers", or some similar terminology. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, a network processor, application specific integrated circuit (ASIC) or other circuitry, field programmable gate array (FPGA), read only memory (ROM) for storing software, random access memory (RAM), non-volatile storage, logic, or some other physical hardware component or module.

Also, an element may be implemented as instructions executable by a processor or a computer to perform the functions of the element. Some examples of instructions are software, program code, and firmware. The instructions are operational when executed by the processor to direct the processor to perform the functions of the element. The instructions may be stored on storage devices that are readable by the processor. Some examples of the storage devices are digital or solid-state memories, magnetic storage media such as a magnetic disks and magnetic tapes, hard drives, or optically readable digital data storage media.

Although specific examples were described herein, the scope is not limited to those specific examples. Rather, the scope is defined by the following claims and any equivalents thereof

What is claimed is:

1. Apparatus for deploying an unmanned marine vehicle into water, the unmanned marine vehicle including a float and a glider connected by a tether, the apparatus comprising:

a buoyant frame including a first frame arm, and a second frame arm spaced from the first frame arm to define a receiving bay between the first frame arm and the second frame arm, wherein the receiving bay is sized to receive the float;

a glider retainer assembly coupled to the buoyant frame and configured to releasably retain the glider; and a payload deployment assembly, including:

an attachment plate coupled to and positioned below the buoyant frame; and a payload compartment releasably coupled to the attachment plate by a payload release, wherein the payload compartment defines a receptacle sized to receive a payload coupled to the glider, and the payload compartment has a density greater than water.

2. The apparatus of claim 1, in which the payload release comprises a pin coupled to the attachment plate and moveable between an extended position, in which the pin engages the payload compartment, and a retracted position, in which the pin is disengaged from the payload compartment.

3. The apparatus of claim 2, further comprising an actuator operably coupled to the pin and configured to move the pin from the extended position to the retracted position.

4. The apparatus of claim 1, in which the payload compartment includes a plurality of fluid access ports.

5. The apparatus of claim 1, in which the payload deployment assembly further includes a spool disposed in the receptacle, wherein the payload includes a tow cable wound about the spool in a coil pattern.

6. The apparatus of claim 5, in which the coil pattern is non-tangling coil pattern.

7. The apparatus of claim 1, in which the payload includes a sensor coupled to a tow cable, and in which the payload deployment assembly further includes a separator disposed in the payload compartment, wherein the separator divides the payload compartment into a lower compartment sized to receive the sensor and an upper compartment sized to receive the tow cable.

8. A payload deployment assembly for use with an apparatus for deploying an unmanned marine vehicle into water, the payload deployment assembly comprising:

an attachment plate coupled to and positioned below a buoyant frame of the apparatus; and a payload compartment releasably coupled to the attachment plate by a payload release, in which the payload compartment separates from the attachment plate when released via the payload release, wherein the payload compartment defines a receptacle sized to receive a payload coupled to the unmanned marine vehicle, and the payload compartment has a density greater than water.

9. The payload deployment assembly of claim 8, in which the payload release comprises a pin coupled to the attachment plate and moveable between an extended position, in which the pin engages the payload compartment, and a retracted position, in which the pin is disengaged from the payload compartment.

10. The payload deployment assembly of claim 9, further comprising an actuator operably coupled to the pin and configured to move the pin from the extended position to the retracted position.

11. The payload deployment assembly of claim 8, in which the payload compartment includes a plurality of fluid access ports.

12. The payload deployment assembly of claim 8, further comprising a spool disposed in the receptacle, wherein the payload includes a tow cable wound about the spool in a coil pattern.

13. The payload deployment assembly of claim 12, in which the coil pattern is non-tangling coil pattern.

14. The payload deployment assembly of claim 8, in which the payload includes a sensor coupled to a tow cable, and in which the payload deployment assembly further includes a separator disposed in the payload compartment, wherein the separator divides the payload compartment into a lower compartment sized to receive the sensor and an upper compartment sized to receive the tow cable.

15. A payload kit for use with an apparatus for deploying an unmanned marine vehicle into water, the apparatus including a buoyant frame for receiving a float of the unmanned marine vehicle and a glider retainer assembly coupled to the buoyant frame and configured to releasably retain a glider of the unmanned marine vehicle, the payload kit comprising:

a payload including a sensor coupled to a tow cable, wherein the tow cable is configured for attachment to the glider of the unmanned marine vehicle; and a payload deployment assembly, including:

an attachment plate coupled to and positioned below the buoyant frame of the apparatus; and a payload compartment releasably coupled to the attachment plate by a payload release, wherein the payload compartment defines a receptacle sized to receive the payload, and the payload compartment has a density greater than water.

16. The payload kit of claim 15, in which the payload release comprises a pin coupled to the attachment plate and moveable between an extended position, in which the pin engages the payload compartment, and a retracted position, in which the pin is disengaged from the payload compartment.

17. The payload kit of claim 16, further comprising an actuator operably coupled to the pin and configured to move the pin from the extended position to the retracted position.

18. The payload kit of claim 15, in which the payload compartment includes a plurality of fluid access ports.

19. The payload kit of claim 15, further comprising a spool disposed in the receptacle and configured to receive the tow cable in a coil pattern.

20. The payload kit of claim 15, in which the payload deployment assembly further includes a separator disposed in the payload compartment, wherein the separator divides the payload compartment into a lower compartment sized to receive the sensor and an upper compartment sized to receive the tow cable.

* * * * *